United States Patent [19]

Warheit

[11] Patent Number: 4,490,224

[45] Date of Patent: Dec. 25, 1984

[54] PROCESS FOR RECONDITIONING A USED AMMONIACAL COPPER ETCHING SOLUTION CONTAINING COPPER SOLUTE

[75] Inventor: Kevin E. Warheit, Butler, Pa.

[73] Assignee: Lancy International, Inc., Zelienople, Pa.

[21] Appl. No.: 600,888

[22] Filed: Apr. 16, 1984

[51] Int. Cl.[3] ..... C25C 1/12

[52] U.S. Cl. ..... 204/130; 204/106; 204/107; 204/108

[58] Field of Search ..... 204/130, 106–108

[56] References Cited

U.S. PATENT DOCUMENTS

| | | | |
|---|---|---|---|
| 2,964,453 | 12/1960 | Garn et al. | 204/130 |
| 4,028,202 | 6/1977 | Ammann et al. | 204/106 |
| 4,280,887 | 7/1981 | Konstantouros | 204/130 |

*Primary Examiner*—R. L. Andrews

*Attorney, Agent, or Firm*—Parmelee, Miller, Welsh & Kratz

[57] ABSTRACT

Ammoniacal solutions that have been employed in a bath for etching copper such as in the manufacture of printed circuits is reconstituted or regenerated to substantially fully remove copper solute therefrom and retain the ammonia content thereof in such a manner as to enable a continuous reuse of the etching solution. The process is conducted in such a manner that no contaminating metal powder, compounds or sludge are formed. The reconditioning is effected by introducing used ammonia solute containing ammonium etching solution into an electrolytic bath in which cathodic and anodic electrode containing compartments are defined by a cationic permeable membrane therebetween with the cathodic compartment having an electronegative cathode electrode plate therein. Normal current generation and flow in the cell is fully restricted and the copper content of the solution is substantially solely plated out as a pure metal slab on the cathode plate electrode by applying a sufficient external direct current potential to the cell, to thereby negate normal current flow of the cell, deterioration of the cathode, and prevent formation of copper powder, metal compounds and sludges within the cell from the cathode metal and the copper solute content of the ammoniacal etching solution. The operation is conducted in such a manner as to conserve the ammonia content of the used copper etch solution and enable the reconditioned solution to be reused with a minimized loss of its active etching ingredients.

16 Claims, 6 Drawing Figures

PROCESS FOR RECONDITIONING A USED AMMONIACAL COPPER ETCHING SOLUTION CONTAINING COPPER SOLUTE

In the manufacture of printed circuit boards it is customary to employ a non-conductive or flexible film onto which a thin film of copper is applied as a surface lamination. Such copper surface is then covered with a photosensitive resist film that is easily removable in areas where the film has not been exposed. The removal of this unexposed film to thus define the circuit design allows a plating of tin-lead alloy, tin or gold to be applied to the pattern circuit with good electrical characteristics and resistance to chemical attack of an etchant solution. This enables the unplated copper film to be removed from the laminate to leave the desired wiring diagram.

For removal of the unwanted copper layer, a variety of chemical etchants have been employed such as solutions of copper chloride and ferric chloride, sulfuric acid with hydrogen peroxide, ammonium persulfate, etc.

BACKGROUND INVOLVED

The process which employs an alkaline solution containing ammonium for etchant purposes is of the type to which the regeneration or reconstituting of the present invention is to be applied.

An ammonia-based etchant has the advantage that it does not attack tin/lead or tin coatings which are commonly used to protect the copper circuit pattern. The most important advantage from a production standpoint is that an ammonia-based etch allows a high copper concentration in the etching solution and a large operating "window" due to its rather stable performance under a wide range of copper concentrations. The ammonia content provides the complexing agent which precludes copper precipitation at the operating pH; the inorganic cupric $Cu^{++}$ ion is the actual oxidant dissolving the metallic copper. Various alkali etching systems have been used employing nitrates, chlorites and chlorides of copper in an ammonium complex. The solution regeneration procedure of the present invention has been developed and found to be economically applicable to all these formulations. However, modification is restricted to substituting an applicable anion used in the etch solution if it is not based on the chloride.

To provide a better understanding of the innovative features of our process dealing with regeneration and our reconstituting of a used etching solution, a brief outline of the physical-chemical reactions in such a system are set forth.

Cupric ion oxidizes the metallic copper of the coating in the reaction:

$$Cu^{\circ}+Cu^{++}\rightarrow 2Cu^{+} \qquad 1.$$

The cuprous ion formed is oxidized by air during a spraying action:

$$2Cu^{+}+O_2\rightarrow 2Cu^{++} \qquad 2.$$

As an ammoniacal complex, this reaction remains basically unchanged:

$$Cu^{\circ}+Cu(NH_3)_4^{++}+2Cl^{-}\rightarrow 2Cu(NH_3)_4^{+}+Cl^{-} \qquad 3.$$

$$2Cu(NH_3)_2^{+}+2Cl^{-}+O_2+4NH_3\rightarrow 2Cu(NH_3)_4^{++}+2Cl^{-} \qquad 4.$$

As indicated from reactions 3. and 4. above, the etching solution gains copper ions and consumes free chloride and ammonia. These changes as carried out in a production operation create a change in the solution composition. By adding ammonium chloride as a maintenance chemical, the solution balance can be re-established, but the continued copper gain adversely affects the etch rate at a certain point and, in a conveyorized proceess line, it adversely affects the quality of the product. Under pressure operating procedure, this problem is alleviated by a continuous, slow wastage of the etch solution. In larger production installations, an automatic density controller measures the copper gain that affects the specific gravity of the solution; a predetermined volume of etchant is then wasted and an equal volume of replenishing solution made up of ammonium chloride and free ammonia is added.

An ideal overall process will involve removing the copper solute from the etching solution at the same rate as it is gained from the etching operation. However, none of the heretofor available processes can accomplish this result in an economical and trouble-free manner. And, as a result, the spent etching solution is usually considered a waste and is sold at a fraction of the value of its copper content. A typical quotation is \$0.05/gal. for a spent solution containing around 180 g/l of copper but the copper contained in that gallon, on the other hand, has a commercial value of about \$1.10. Deductible from this meager rate of return are shipping and handling costs which vary in relation to the distance to the nearest recovery depot. A further and significant completely unrecovered loss in this type of utilization, is the ammonium chloride content which has an appreciable value independently of the copper which is lost, of \$0.87/gal., based on a typical current vendor price for ammonium chloride solution. This is also a significant value factor.

The rinse waters also carry a significant quantity of copper and chemicals lost by dragout with the circuit boards which are about two to three times the normal dragout losses encountered in metal finishing, in view of the high density of the solution (sp. gr. 1.25). Obviously recovery from diluted rinse water is uneconomical when the processing solution, itself, has to be wasted due to the lack of a recovery method. It is estimated that this loss is approximately 6 gallons/500 sq. ft. of a one-sided circuit board surface that is being processed. A successful process in this connection will reduce the complexity of waste treatment problems the industry faces. Both copper and ammonia, in view of their concentrations, are considered toxic for aquatic biota and, if discharged into a sewer system, are toxic for bacteria in the sewerage treatment process and for surface waters into which treated sewage is discharged.

Thus, it has been an object of the present invention to develop what may be termed a closed loop or continuous regenerating system to reduce the complexity and the costs of waste treatment for a particular plant, whether it represents a relatively small or a large distillation.

THE PRIOR ART

The above problems are well recognized and various approaches have been proposed for metal recovery and solution regeneration. Metal recovery can, itself, be achieved by changes in solution chemistry, such as volatilization of the ammonia, followed by a complete precipitation of the copper solute as an hydroxide and a metal powder from which copper can be recovered by electrolytic means by the use of a sulfate electrolyte. When the aim is to provide a controlled copper removal with a return of the solution to the etching solution, the problem is greatly magnified and only a few processes claim to be able to meet this objection. B. Whalen (see pages 20 and 21 of the article titled, "Closing the Loop on Etchants", published in the journal entitled "Printed Circuit Fabrication") discusses these issues somewhat thoroughly.

U.S. Pat. No. 4,083,758 is based on a process in which the solution is contacted by a liquid ion exchanger (reagent) in an organic solvent. After intimate mixing, copper is stripped from the water phase and combined with the liquid ion exchanger in the organic solvent. After phase separation, the solvent is washed with water and subsequently contacted by an acidic solution (such as sulfuric acid) which strips copper from the liquid ion exchanger, in order that the solvent may be reused again after water washing for solvent extraction. It is stated that copper can be recovered electrolytically from the acid stripping solution while, as claimed, the stripped etching solution, after filtration over activated carbon, can then be returned to the etching process for further usage. As a process engineer, I know that an installation such as thus outlined will require a complex equipment arrangement and considerable operating and maintenance labor. These factors make this approach clearly impractical for a small scale utilization, such as in a printed circuit fabrication shop.

U.S. Pat. No. 4,303,704 teaches the removal of copper using a special ion exchange resin system. It is mainly applicable for rinse waters due to the fact that the copper content is so high in the wasted etch solution that its regeneration will require a very large resin capacity and an uneconomical high cost in regeneration chemicals.

U.S. Pat. No. 4,280,887 teaches a regeneration of copper from an ammoniacal etching solution using electrochemical forces generated by immersing a base metal electrode (aluminum or iron) into the spent etching solution electrolyte. Electrochemical displacement will remove some the copper as a metallic powder while the aluminum will dissolve, displacing the copper from its salt in the solution. The electrochemical action is caused in this process by connection of the two dissimilar metals, one of which is close to the positive end and the other of which is close to the noble (negative) end of the electromotive series. As aluminum dissolves under this inherent electrochemical action, it precipitates as hydroxide and tends to bury a spalled-off copper powder deposit, thus producing a heavy sludge in the solution. It is questionable if there is any value in the recovered copper because of its mixture with aluminum hydroxide sludge which will have to be washed free of the etching solution electrolyte. The usefulness of the depleted etch solution as a hoped-for regenerated etchant is questioned, since the soluble aluminum will not be completely precipitated and will tend to contaminate the circuit board copper conductor material. As far as we have been able to determine, this process has not found acceptance in the industry, as exemplified by Whalen's failure in her article to mention it among known commercial processes.

To our knowledge, another process has been developed by the British Electric Council Research Center which, according to Mr. Hillis, see pages 73 to 76 of an article entitled "The Electrolytic Regeneration of Spent Ferric Chloride Etchant", is an electrolytic recovery process that was originally designed for regeneration of an acidic cupric chloride etching solution that by electrodeposition, is said to enable a continuous removal of a small amount of copper therefrom. The basic approach of this process is to use an electrolytic cell in which the anode half is segregated from the cathode half of a cationic membrane. The etching solution is recirculated through the anode half, and copper cations migrate through the membrane and deposit on the cathode as a loose, non-adherent copper powder. Periodically, the cell is emptied of solution and accumulated copper powder is removed as a by-product of the solution maintenance operation. At the time the published lecture was given in June of 1981, it was indicated that for the alkaline etch, the process was still in a laboratory development stage, but that it was anticipated that it would meet industrial requirements. In this process, it appears that ammonium ions will be in competition with the copper ions with respect to a transfer through the cationic membrane. This will undoubtedly slow down copper ion transfer that is limited in any event by the number of ion exchange sites in the membrane. With such a reduced copper transfer, the electrolytic copper powder deposition rate and the applicable current density are limited. In addition, with an anticipated nearly equal migration of ammonium ins through the membrane, a secondary limitation for copper transfer is presented, along with the simultaneous loss of ammonium ions from the etching solution.

The loss of ammonium from the above process solution means, firstly, a change in the balance of chemical formulation of the etching solution, necessitating frequent analytical supervision. Secondly, there is an important loss in chemicals. From an economical standpoint, the generation of copper powder as a by-product is thus not a viable copper recovery approach. Also, our experience has taught us that copper powder has a low scrap value and because of the large surface area presented by the powder, a large percentage of it becomes oxidized. Copper powder, as recovered as a settled sludge from an electrolytic solution for use in smelting, requires several washings to free it of salt residuals present in the catholyte. Our findings are to the effect that the only economical metal recovery approach for the metal finishing industry, is to recover the metal as pure metal in a directly reusable form, such as a high purity plate, that can be subsequently reused as an anode metal in a copper plating process or which can command top value as high grade pure copper metal scrap.

BRIEF DESCRIPTION OF THE DRAWINGS

In FIG. 1, the chart is based on a 180 g/l concentration of soluble copper in the solution being treated, an operating temperature of 75° F., and a rest potential of 199 mV.

In FIG. 2, the concentration is 30 g/l, the temperature is 75° F., and the rest potential is 373 mV.

In FIG. 3, the concentration of copper is 30 g/l, the temperature is 130° F., and the rest potential is 375 mV.

In FIG. 4, the concentration of copper in solution is 5 g/l, the temperature is 83° F., and the rest potential is 412 mV.

In FIG. 5, the concentration is 5 g/l of copper solute, the temperature is 130° F., and the rest potential is 404 mV.

Figure 1:
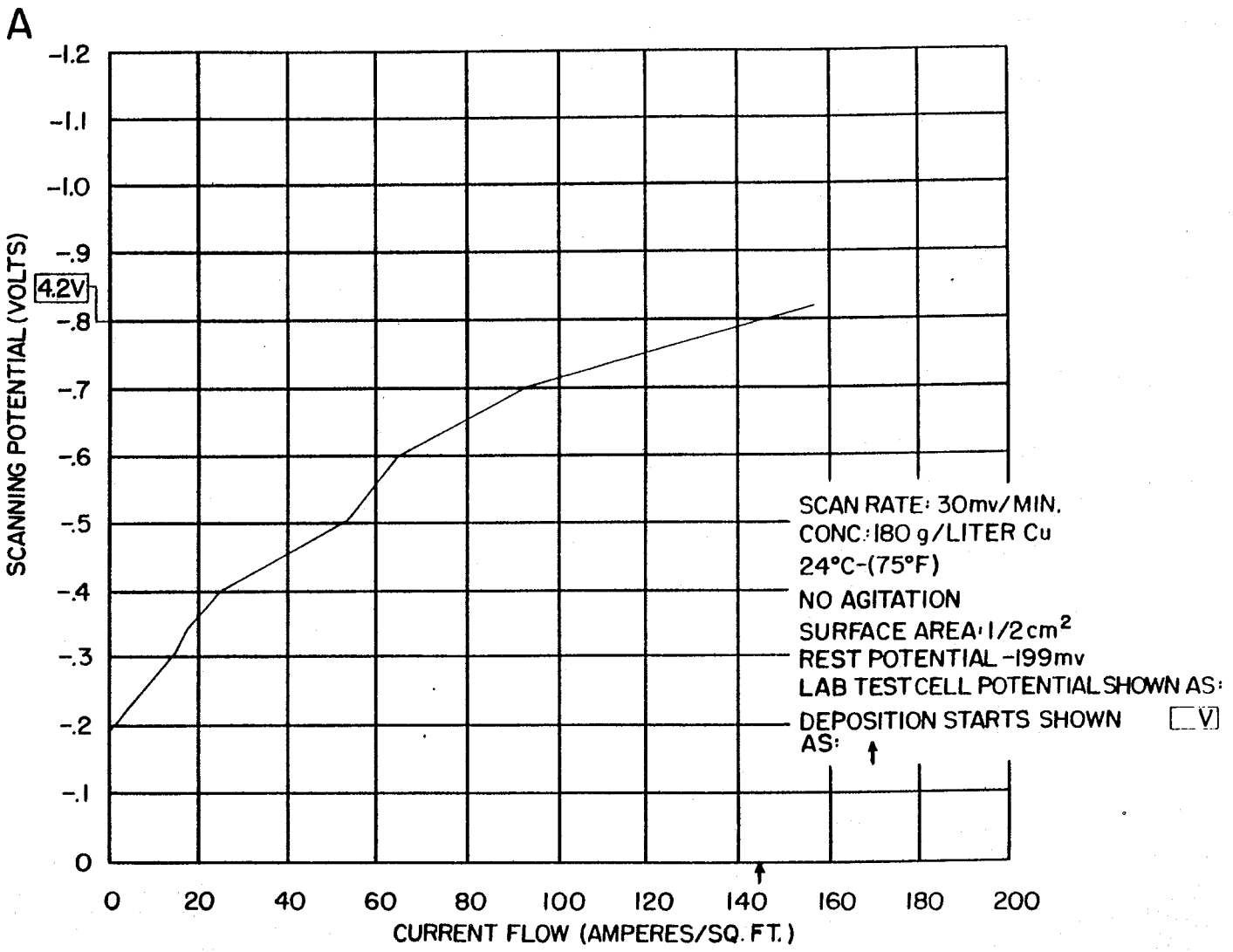
FIGS. 1 to 5 of the drawings represent current flow charts in which current flow ($A/ft^2$) is plotted against scanning potential in volts where an external direct current is applied to an electrolytic cell employed to convert copper solute in a used etching solution into a pure metal slab.

In accordance with the present invention, pure copper metal is plated in slab-like form on a steel or iron cathode in an electrolytic cell using an insoluble metal anode, such as of lead, in which the cathodic and anodic compartments are defined by a separating cation exchange membrane that functions to block the transfer of anions into the anodic compartment. The used etch solution is removed from the etching bath at the rate necessary to maintain the etching process and is introduced into the cathode compartment where the copper is maintained at a concentration of 80 g/l or less by the applied current. Further, to prevent the loss of ammonia in the solution, the chemical composition of the electrolyte in the anode compartment is controlled in such a manner that an appropriate concentration of an ammonium salt (such as a sulfate, a chloride, an acetate, a sulfamate, etc.) is maintained to provide an ammonium ion concentration in a range of about 1.5 to 20 g/l, and so as to provide a pH therein within a range of about 4.0 to 10.0. Also, for optimum results, the etch solution being treated in the cathodic compartment is held at a pH of less than 8.0 while the pH of the copper depleted solution therein is increased to above such a pH when it is returned to the etching process. Reducing the pH of the rinse water before evaporatin to a value of less than about 8.4 enables a minimization of ammonia losses during evaporation.

SUMMARY OF THE INVENTION

It has been an important object of the present invention to overcome the seemingly insurmountable problems involved in providing a controlled process for directly recovering copper as a pure metal from an ammonia based etching solution in which copper is a contaminating solute.

Another object has been to recover copper from such a solution in the form of high purity metal slabs of solid copper while retaining desired chemicals in the etching solution, and avoiding the forming of metallic compounds and sludge that contaminate it.

A further object of the invention has been to devise a process for reconditioning a used etching solution in which its ammonia content will be conserved and prevented from being evaporated or otherwise lost, all in such a manner that after its copper content has been removed in pure metal form, the remaining solution may be reused, as by recombining it with used etching solution, all in such a manner as to enable a continuous, highly economical operation.

In accordance with the present invention, pure copper metal is plated in slab-like form on a steel or iron cathode in an electrolytic cell using an insoluble metal anode, such as of lead, and in which cathodic and anodic compartments are defined by a separating cathodic membrane that functions to block the transfer of anions. The amount of externally applied electrical current is first sufficient to overcome or offset corrosion current generated by the etch solution to assure protection of the cathode and then, in a sufficient amount to cause an electroplating action. Further, to prevent the loss of ammonium in the solution, the chemical composition of the electrolyte in the cathode compartment is controlled so that the concentration of the ammonium salt which may be a sulfate, a nitrate, a chloride, an acetate, a sulfamate, etc. is maintained within a range of about 1.5 to 20 g/l and so that the pH therein is within a range of about 4.0 to 10.0. Also, for optimum results, the etch solution being introduced for treatment into the cathode compartment is held at a pH of less than about 8.0, while the pH of the copper depleted solution therein is increased to above such a pH before or when it is returned to the etching process. The pH of the solution, as an optimum, is reduced to a value of less than about 7.6 to enable a minimization of ammonium losses due to evaporation in the electroplating cell.

In carrying out the invention and solving the problem involved, we have developed a process wherein an extraordinarily fast removal of the copper solute content of a used etching solution is actively plated out as a pure metal slab on a plating cathode from which it can be removed, as by peeling it off. We recognize from the prior art that a cationic membrane could be used as a barrier in an electromotive cell to enable a partial recovery of a copper content in powder form. However, as previously pointed out, this entails a considerable loss of the value of the copper as well as in the formation of aluminum hydroxide from dissolution of the anode, resulting in the forming of a contaminating sludge. In experiments with such a membrane, we found that electrodeposition will remove copper from the catholyte faster than copper ions can be moved through the membrane, thus starving electrolyte etchant adjacent to the cathode of metal ions. This makes impossible the deposition of an adherent, continuous copper plate. Essentially, such an inherent electrochemical operation as set forth in U.S. Pat. No. 4,280,887 is totally impractical for this purpose.

In view of the fact that most ammonia based etching solutions are based on the use of chloride salts, a second problem was faced from the standpoint of discovering a suitable substantially insoluble anode metal with good resistance to anodic attack by a high chlorine content. An expensive metal, such as platinized titanium or the like, such as used for electrolytic chloride generation, was considered. To overcome this difficulty we found that a membrane should be installed to isolate the solution next to the anode (anolyte) from the etching solution that is to be regenerated. An advantage in pursuing this approach is that a chloride free anolyte can be used to thus eliminate chlorine gas generation at the anode. It was also recognized that an ammonia-based etching solution will react with chlorine gas generated at an anode to convert ammonia to chloramines and result in the inability to enable a continuous type of usage of an etching solution.

In order to achieve our desired aims, the only approach found to be successful involved applying an external source of cathodic current to provide the cathode with a protective potential to prevent a normal type of inherent internal electromotive current flow that would otherwise occur. Also, we determined that when the internal electrochemical potential is exceeded by the application of a relatively high external current application that electroplating action would commence at a relatively low external electric current consumption efficiency.

From our experiments we determined that there is a critical relation between the copper concentration of the solution and the amount of external direct current that has to be applied to both overcome the inherent reverse electrochemical current flow of the cell, and to efficiently and effectively produce a pure metal plate on the cathode without the formation of copper powder. The importance of this is illustrated by the examples of Experiments 1 through 5 herein set forth and the charts of FIGS. 1 through 5, inclusive.

Briefly stated, the process requires the use of higher current densities for the achievement of a proper efficiency of operation, the assurance of relatively low wattage expenditure and, at the same time, maintaining the used etching solution in the cathode compartment low enough in copper concentration. That is, it is essential to control the operation to substantially prevent a corrosive effect on the cathode and to assure a plating-out of the soluble copper content of the solution.

In our experiments, we used a commercial etch solution and one that is claimed to have an outstanding etch rate for copper removal, the idea being that if the experiments are based on using a well known high production etch solution, the results would be equally applicable for all types of etch solutions in commercial use. We thus, for our etching solution in our experimental work, employed "Ultra-Etch-50", a trademarked product that is sold by MacDermid, Inc. of Waterbury, Conn. This solution in its working range contains about 160 to 200 g/l of copper, about130 to 160 g/l of $NH_4+$, and about 110 to 150 g/l of Cl—, and with a pH of 8.4 being attained by adding $NH_4OH$ to reach a suitable operating pH. At a temperature of 130° F., this solution is said to etch 0.003" of copper per minute from a circuit board.

From the standpoint of economical justification, one gallon of etch solution replenisher (168.5 g/l $NH_4Cl$) at the present time costs $0.87 when purchased in 2,000 to 3,000 gallon lots. The value of the copper contained in a spent solution, as previously pointed out, is at this time, about $1.10 per gallon.

The following are examples of experiments conducted in arriving at a solution to the problem herein involved.

EXAMPLE 1

In this series of experiments, a 203 g/l copper containing etch solution was electrolyzed in an electrolytic cell using a cation permeable membrane "Nafion" (a trademarked product of E. I. DuPont & Company) to isolate the anode compartment from the cathode compartment of the cell in accordance with our theory. For the anolyte, a solution of 16 g/l of sodium sulfate was used at a pH of 6.5 to 7.6. A steel plate was used as the cathode and a lead plate was used for the anode of the electrode assembly. The catholyte solution was provided by a completely spent etch solution having a 203 g/l copper solute content. The remainder of the chemical content was in the same ratio as indicated above for the operating solution. The experiments involved: no agitation and mild agitation; operation at room temperature (72° F.) and at an elevated temperature (130° F.); and externally applied current densities for the electrodeposition, starting at moderately high levels and increasing as noted.

| Cu Con. g/l | Agitation | Temperature | Current Density A/sf | Power Consumption Efficiency KW/Kg | Observations of the Deposit |
|---|---|---|---|---|---|
| 203 | None | 72° F. | 160 | 36.0 | Adherent and peelable, shiny copper plate |
| 203 | None | 72° F. | 307 | 1.30 | Adherent and peelable, shiny copper plate |
| 203 | Mild | 72° F. | 160 | — | No plating |
| 203 | Mild | 72° F. | 173 | — | No plating |
| 203 | Mild | 72° F. | 192 | — | No plating |
| 203 | Mild | 72° F. | 212 | — | No plating |
| 203 | Mild | 72° F. | 230 | — | No plating |
| 203 | Mild | 72° F. | 259 | 482.1 | Non-continuous poorly adherent deposit |
| 203 | None | 130° F. | 160 | — | No plating |
| 203 | None | 130° F. | 192 | — | No plating |
| 203 | None | 130° F. | 210 | — | No plating |
| 203 | None | 130° F. | 230 | — | No plating |
| 203 | None | 130° F. | 287 | — | No plating |
| 203 | Mild | 130° F. | 160–300 | — | No plating under any of these conditions |

From the above experiments, it was evident that our aims could be achieved by active electrolysis of the etch solution, but that a suitable copper deposit could only be achieved when the solution was not agitated and was held at room temperature. However, from a practical standpoint, it was found to be desirable to overcome their adverse effects, since we found that at least mild agitation is advantageous to insure that the solution has a uniform concentration. This is especially true when the aim is to return to the process a solution depleted in copper, and to add to it a spent solution that is high in copper content to thus produce a copper content that will not inhibit removing of the copper film from the laminate. Also, operating at room temperature presents a drawback from the standpoint that at the required high current density, a considerable amount of heat is generated and a chiller would be needed for holding operating temperature to about 72° F.

EXAMPLE 2

When working for an extended time with a sample at room temperature and no agitation, it was noted that as the solution becomes depleted of copper, there is a surprisingly accelerated weight gain of the deposit and it was found that the deposition at a somewhat lower current density could be maintained. To elucidate, this observation would indicate that a lower copper concentration could possibly be employed with further effect of greatly reducing the natural corrosion effect of the electrolyte. We thus undertook a study of the corrosion current flow at various potentials and at various copper concentrations for the same basic electrolyte or etching solution.

For this study, a Corrosion Measurement Systems, Model 331-14 3, as manufactured by EG&G Princeton Applied Research, was used. It consists of a potentiostat/galvanostat module, a programmer-computer, an applicable corrosion cell, and a graphic recorder of the scan created by the instrument. From the scan generated by the instrument, we read "rest potential" values, that is the electromotive potential generated on a copper sheet by the solution with no externally applied electromotive force, to thus observe the effect of an externally applied potential on current from the cathode. Such "rest potential" readings confirmed our experimental observations that a reduced copper concentration leads to a reduced corrosion effect, since they were lower (higher negative mV readings) at lower copper concentrations. The instrument also confirmed the fact that the use of an elevated temperature and agitation tend to increase corrosion effects to the solution by showing more positive "rest potentials". To better illustrate information gained from this study, we converted the instrument scans to a series of graphs (see FIGS. 1 through 5, inclusive) to indicate the "rest potentials" that are due to a particular copper concentration in otherwise chemically identical etch solutions. The electrical potential generated by the instrument's power source was plotted vs. the current flow generted by the applied potential.

To aid us in illustrating the need for relatively high current densities to overcome the corrosion or etching reaction and the copper and electrode dissolution that would otherwise block our efforts for full pure copper metal deposition, we converted logarithmic current values charted by the instrument to current density values. This facilitated comparison with the results of our experiment work. The current densities are all in amperes/sq. ft. (A/sf).

From the graphs of FIGS. 1 through 5, it will be apparent that a significant direct current has to be impressed on the cathode before electrodeposition can begin. We have indicated on the graphs the voltage needed in our plating test cell to reach the point at which initiation of plating will occur and the corresponding current density thus generated. Our experiments show that, with this potential and current density, a visible copper density will commence and build up to an adherent plate. However, close to this potential, the calculated utilization of the current for copper deposition is rather low and increased current input is needed to maximize power consumption efficiency of the cell. Although an elevated temperature and high rate of agitation both increase the rate of corrosion reaction, they also allow the use of higher current densities and the achievement of higher current efficiencies. For this reason, our efforts to reduce power loss to overcome the corrosion created by the etch solution have been mainly directed towards maintaining a reasonable low copper concentration in the copper deposition compartment of the etch solution regenerating process.

DETAILED DESCRIPTION OF THE DRAWINGS

Graph A of FIG. 1 illustrates the conditions reported in Example 1, but in a 180 g/l copper etching solution instead of the 203 g/l therein employed. It was determined that copper plating started only when about 145 A/sf of applied current was exceeded at the scan voltage of 800 mV, equivalent to 7V in our laboratory cell. The data from the scan was very close to our practical experience as reported in Experiment 1, and indicated the approximate 0.609 KW/sf of power consumption to enable reaching a point where copper deposition starts in order to produce a peelable, pure copper metal, adherent deposit.

Figure 2:
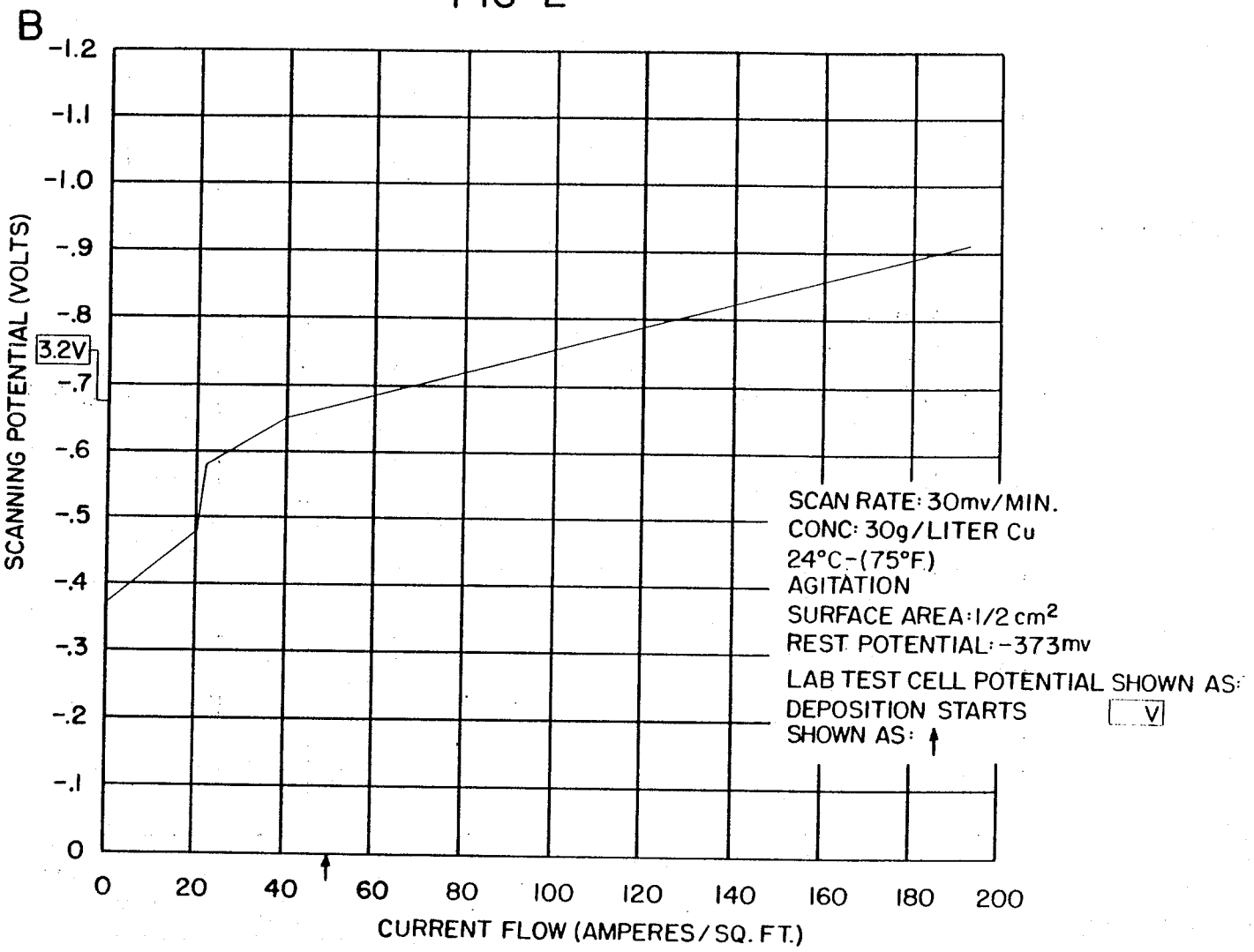
Figure 3:
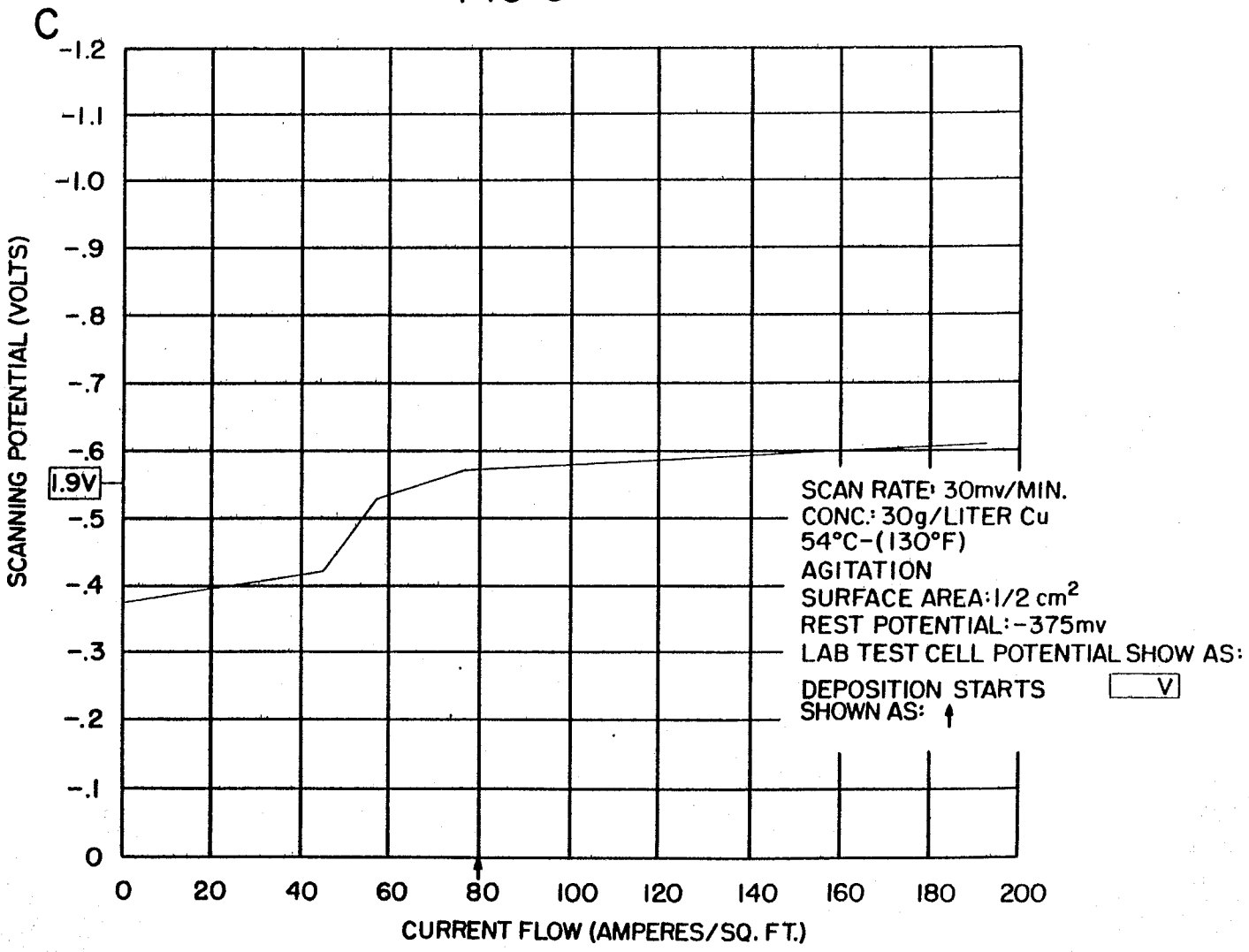

Graphs B and C of FIGS. 2 and 3 show conditions found by the above-mentioned test instrument in a 30 g Cu/liter etch solution at both room temperature 72° F. and at a raised temperature of 130° F. It will be evident that the "rest potential" is considerably more negative, and that the current required to counter corrosion current and initiate copper deposition is greatly reduced. Power consumption to initiate a peelable deposit was found to be reduced to approximately 0.152 KW/sf.

Figure 4:
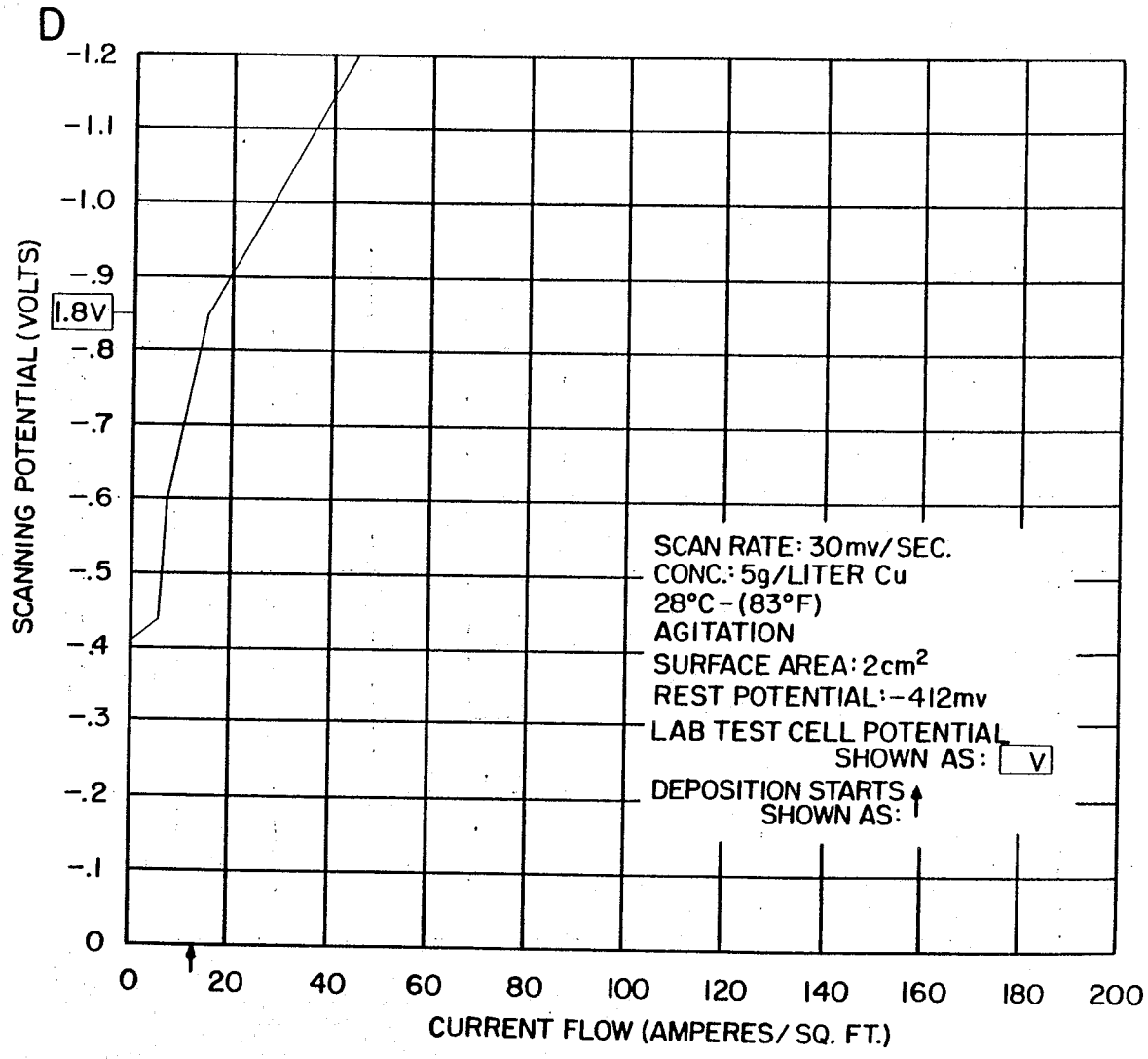
Figure 5:
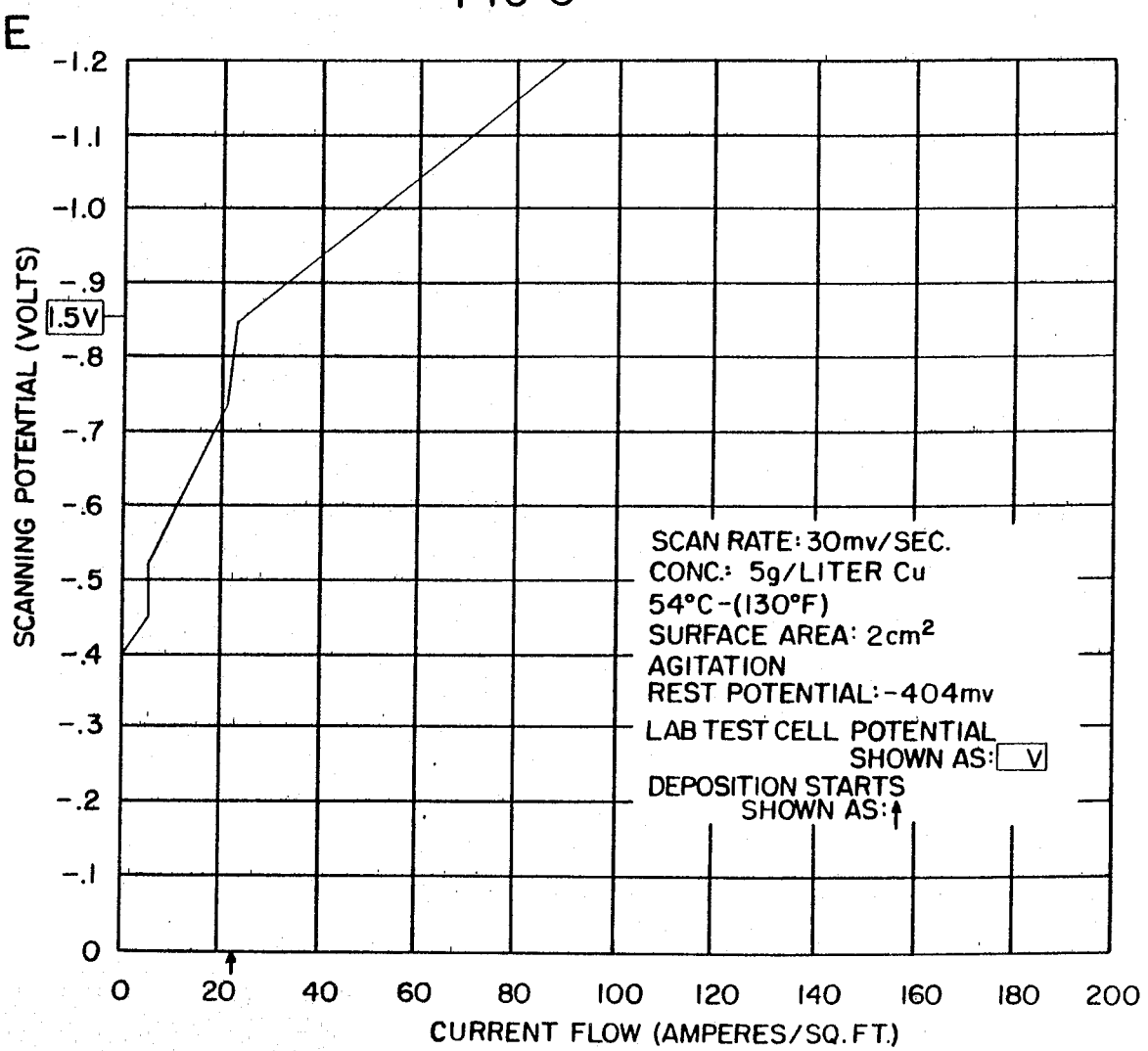

Graphs D and E of FIGS. 4 and 5 show conditions found in the investigation using a 5 g Cu/liter content in the etch solution. The trend for a lower potential requirement and a reduced current flow for copper deposition with lower copper concentrations is further indicated. In this situation, power consumption to initiate a peelable deposit was further reduced to about 0.03 KW/sf. In view of such results, we proceed with our investigation to experiment with lower content etch solutions to determine if we could confirm our laboratory cell plating tests which were demonstrated in our corrosion studies. As to corrosion, we have reference to the normal reaction and current flow which occurs in an electrochemical solution containing copper, in the absence of an application of an outside source of electrical energization.

EXAMPLE 3

On the basis of our study set forth in Example 2, it was indicated that pursing this approach we could reach goals that we set out to attain in a more economical manner. We thus concentrated our efforts in developing the process at a reduced copper concentration in order that it would regenerate the used etch solution by only removing copper without in any way significantly altering the chemical composition of the etch solution. This is a highly important factor in attaining our desired improved results. Our secondary goal has been to economically recover copper in a fully reusable form. To achieve our aims as previously set forth, we considered a process in which the electrolytic deposition conditions would be similar to those described in Example 1, except for the concentration of copper in the etch solution. We envisioned a process in accordance with which the electrolyte is made with the same chemical background as the etch solution and with copper that is added from a spent solution. In practice, spent electrolyte should be added to maintain a desired copper concentration and the same volume of copper-depleted electrolyte can then be returned to the etching process. The following is the experimental data obtained which indicates the importance of at least about 73 amperes per square feet of electrode surface and a suitable copper solute concentration in attaining a pure metal plating out of the copper that is in the form of a solute in the aqueous etch solution:

| Cu Con. g/l | Agitation | Temp. | A/sf | Volts | Kw-hr/Kg | Observations |
|---|---|---|---|---|---|---|
| 1 | Rapid | 130° F. | 5.21 | .5 | 0.59 | Powdery, poorly adherent deposit |
| 5 | Rapid | 130° F. | 73.68 | 1.8 | 1.24 | Adherent and peelable, shiny copper plate |
| 30 | Rapid | 130° F. | 187.5 | 4.0 | 5.06 | Adherent and peelable, shiny copper plate |
| 80 | Rapid | 130° F. | 210 | 6.5 | 12.14 | Adherent and peelable, shiny copper plate |

Our data indicates that electrolysis conditions are sufficiently changed by simply reducing the copper concentration in the electrolyte to achieve the goals of the invention at a significantly improved electric power consumption efficiency, such as to make the recovery of a copper slab product an economical process. That is, considering a cost of 5¢/KWhr. as an average power cost, the operating cost of copper winning at 5 g/l is only 6.2¢/Kg (2.8¢/lb.). On the other hand, the present value of electrolytic copper is in the range of $1.65 to $1.87 /Kg (75¢-85¢/lb.).

EXAMPLE 4

During the pilot plant phase of our research we noticed a significant ammonia loss to the atmosphere from the etch solution when operating the recovery process at a high rate of stirring or agitation. Ammonia loss will also be encountered if the copper and chemical values from the rinse water are to be recovered using an evaporator for reconcentration of the rinse water. As discussed earlier, the dragout loss to the rinse water is significant. We also discussed the cost and complexity of the waste treatment approaches that have heretofore been used. Chemical and copper dragout losses and also waste treatment costs can, we have determined, be eliminated if the equipment installed for the etch solution regeneration can also be useful for the recovery of the dragout losses. One of the easiest methods of reconcentrating the rinse water for return to an original process solution is by evaporation, especially when the volume of rinse water consumpton is under tight control. In addition to the earlier discussed ammonia losses that may occur in the recovery cell, evaporation reconcentration of the rinse water will greatly increase such losses. Our research effort therefore has been extended to a process control of such a nature as to minimize or substantially eliminate such ammonia losses. As indicated by the data tabulated below, by reducing the pH of the etch solution with the addition of hydrochloric acid to provide a pH of less then 7.6, it has been discovered that ammonia losses due to volatilization can be substantially completely avoided. When the etch solution has been held for two hours at 130° F., with air sparging through the solution, the following ammonia losses were recorded:

pH 8.4: 1210.0 mg $NH_3\uparrow$ /l
pH 8.0: 375.1 mg $NH_3\uparrow$ /l
pH 7.6: 65.3 mg $NH_3\uparrow$ /l
pH 7.0: 12.7 mg $NH_3\uparrow$ /l A slight chlorine gain due to this pH change does not adversely effect the etch solution. Instead of adding ammonium hydroxide and ammonium chloride for maintenance additions to replenish ammonia losses in the etching process, a higher percentage of ammonium hydroxide is required in the replenisher additions.

EXAMPLE 5

We also found that a small amount of ammonium is lost by migration to the anode compartment, even although ammonia is a cation and therefore such migration is not caused by electrolytic action. It appears that dialysis may be the cause of this loss. However, we have found that maintenance of an ammonium ion concentration in the anolyte of about 2.5 to 20 g/l and, as an optimum, to 10 g/l in the form of an ammonium salt, such as sulfate, at a concentration of 20 to 80 g/l will minimize such a loss to the anolyte. It is well known that pH changes can drastically influence the transport of inonic species across ion exchange membranes due to the Donnan dialysis principle. Thus, control over the chemical composition of the anolyte in the electrolytic regeneration process has an important influence on the ability to continuously reuse the etching solution.

Figure 6:
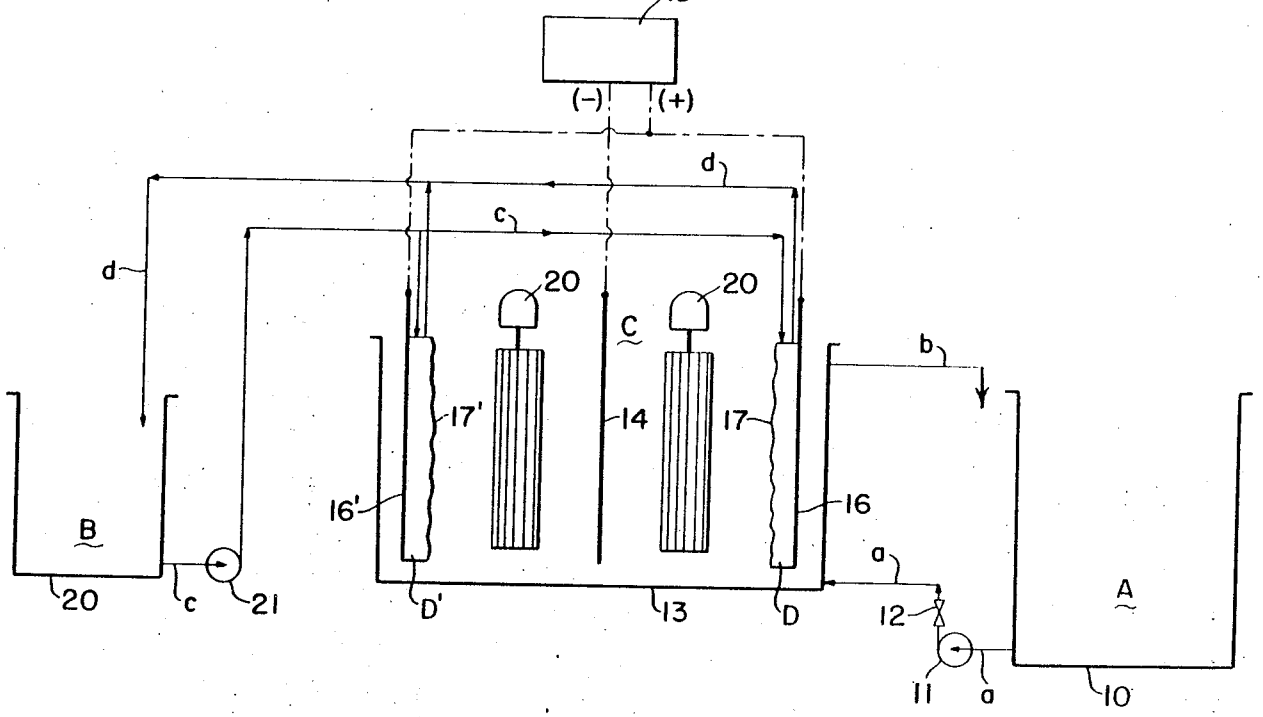
FIG. 6 is a somewhat diagrammatic view in elevation of a system employing the inventive process.

In carrying out the invention, a system such as illustrated in FIG. 6 may be employed. Initially, a cathodic compartment C for an electrolytic cell 13 is provided with an ammonia etching solution that is equivalent to a new solution having a little or no copper solute content that would be used in starting a copper etching operation. Also, an aqueous ammonia anolyte solution B is prepared in a tank 20 by introducing an ammonium salt such as ammonia sulfate, chloride, acetate or a sulfamate, as tempered with hydrochloric acid and ammonium hydroxide to attain and maintain therein a pH within a range of about 4.0 to 10.0, and an ammonium ion concentration within a range of about 1.5 to 20 g/l. An optimum pH is about 7.5. The anolyte thus produced is introduced into anode compartments of zones 17 and 17' of the cell 13 through line c and metering pump 21 and returned in a circulatory path through line d to the tank 20 where its pH and ammonium ion content may be monitored.

To start the operation, a metered pump 11 is used to remove used copper solute pregnant or contaminated etching solution A that is to be treated from a tank 10 and through a back-flow preventing valve 12, to introduce it directly into a bottom portion or end of the cathode compartment C of electrolytic cell 13. The compartment C may, as shown, be provided with a centrally positioned cathode 14 of a suitable metal such as iron, stainless steel or copper which, in the operation, provides surfaces (preferably planar) on which copper in pure metallic film or slab-like form is deposited, and from which pure copper may be peeled-off from time to time as the operation progresses.

To maintain the solution in the cathode compartment C with a uniformity of concentration and pH, electric motor-driven agitators 20 and 20' may be provided in a spaced-apart suspended relation on opposite sides of the cathode 14. The agitators may be of a conventional type with sealed-off motor drives. Initially, as above indicated, in starting up the operation, both the cathodic compartment C and the anode compartments D and D' are filled with ammoniacal solutions before used contaminated copper solute containing ammonia etching solution A from a copper etching operation is introduced, as from representative etcher sump or tank 10. Each anode compartment D and D' has an anode therein of a suitable insoluble metal such as lead, stainless steel, platinized titanium or niobium. The cell 13, as shown, may be provided with permeable cationic selective membranes 17 and 17' that isolate the cathodic solution of compartment C from the anodic solution of compartments D and D'. The anodic compartments D and D' close-off their anodes 16 and 16' within and with respect to the cathodic compartment C, except for the membranes.

The operation is initiated by applying positive electric direct current voltage from an alternating to direct current rectifier 15 to supply current flow to the electrodes 14 and 16, 16' to first overcome the "rest" potential of the cell 13 and to then, after used copper-solute contaminated effluent is introduced into the cell, actively start an electroplating operation. To prevent loss of ammonia by evaporation, the used pregnant solution introduced into the catholyte compartment C is reduced and maintained at a pH of less than 8.0 (as an optimum of less than 7.6) by the introduction of a suitable acid, such as hydrochloric acid. As indicated in the discussion of Example 4, hereof, this enables substantial elimination of ammonia loss by evaporation from the pregnant effluent being reconditioned in the cathodic compartment or zone C. Also, membranes 17 and 17' prevent loss of chloride, nitrate, etc. of the ammonium compound into the anodic compartments D and D' from the pregnant effluent being conditioned in the cathodic compartment C. As previously indicated, the maintenance of an ammonium ion concentration in the anolyte solution of about 1.5 to 20 g/l and a pH within a range of about 4.0 to 10.0 prevents migration of ammonium from the cathode compartment into the anode compartment by dialysis.

The controls and the permselective membranes 17 and 17' of FIG. 1, not only serve to prevent the loss of ammonia from the cathodic compartment C, but also prevent migration into the anodic compartments of chlorine in the case of a preferred ammonia etching solution or of a nitrate, in the case of nitrate type of ammonia etching solution. In other words, the desirable content of etching chemical ingredients of the pregnant, spent or used etching effluent that is introduced into the compartment C under the operating conditions of the invention, is substantially retained, while the undesirable copper solute content, is removed and in pure metal form. The copper removal is accomplished without building up colloids, precipitates, metal powder, etc. in the cathodic compartment, and solely as a pure metal in a plated-on relation as to the cathode 14.

As earlier indicated, it is important to overcome and prevent what may be termed an inherent or normal electro-chemical corrosion reaction in the tank 13 in carrying out the inventive process. This is represented by a "rest" potential which is increased with agitation and temperature elevation. As shown, a suitable electroplating potential is provided by an A.C. to D.C. rectifier 15 which will have conventional electrical controls for providing and maintaining a preferred operating range of about 0.5 to 10.0 volts or within an optimum of about 2.0 to 3.5 volts.

Using a system, such as diagrammatically indicated in FIG. 6, when the copper solute content of the used aqueous ammoniacal etching solution A reaches a concentration of 180 to 200 g/l, it may be introduced in a continuous manner from a representative sump or tank 10 through metering pump 11 into the bottom zone, portion or end of cathode compartment C of the tank 13. The initial provision of a non-copper containing starting solution in the cathode compartment c and thereafter, the control enabled by the metering pump 11 as to entering used or copper-pregnant solute-containing etching solution. A, enables a substantially immediate lowering of a concentration to about 80 g/l or less and a maintenance of the entering solution by the plating action effected by the cathode 14 and energizatior supplied by the alternating to direct electric current rectifier 15. This enables a continuous type of operation in which the metering feed through the agency of the pump 11 corresponds to gravity take-off of copper-solute deficient, reconditioned or treated solution from an upper portion or level of the tank 13 through line b. The take-off is thus at a rate corresponding to the rate at which the pregnant or copper solute containing effluent enters through the line a.

A reduction of the copper solute content of about 180 to 200 g/l to 80 g/l or less is accomplished within the tank 13 and during continuous movement of the etching solution. This enables a material reduction in the copper solute content of the aqueous ammoniacal effluent, such that it may be directly mixded or used with solution being employed in an etching operation, without any further treatment. However, its pH will normally be increased from its about 8 or less amount before its recycled etching reuse by the addition of, for example, ammonia hydroxide. Since the content of the ammonia chloride, nitrate, or other etching ammonia compound, as the case may be, is substantially retained, the reconditioned solution will only need, from time to time, additions to replace or offset the loss resulting from its usage in effectin previous copper etching operations.

It is important that the operation as to the copper pregnant etching solution or effluent is one that is effected entirely within the cathodic compartment C of the tank 13, and that is solution content is isolated from the anodic compartment or compartments D and D' throughout the operation. Reconditioned solution or effluent is shown as continuously removed by gravity from an upper portion or end of the cathode compartment C and may then be introduced into a suitable retaining tank where its pH may be raised above 8 by the addition of, for example, ammonium hydroxide, and where any additional ammonium compound that may be needed is added to replace a portion lost in its previous use in etching operations.

I claim:

1. A process of recovering copper in slab-like metal form from and of reconditioning a used ammoniacal copper etching solution containing contaminating copper solute for its reuse which comprises, providing an electrolytic cell with a cationic permeable membrane separating it into cathode and anode compartments, providing electrodes for the cell comprising a cathode for the cathod compartment and an anode for the anode compartment, providing and maintaining ammoniacal solutions within the anode and cathod compartments, introducing used ammonium copper etching solution having a contaminating soluble copper solute content into the cathode compartment of the cell, while removing substantially reusable ammonium etching solution therefrom, applying sufficient direct electric and voltage to the electrodes to offset normal electromotive current flow in the cell and effect electroplating-out action on the copper content of the solution, and controlling the application of the electric current and voltage, the pH of the solution in the cathode compartment, and the ammonium ion concentration and pH in the anode compartment to plate-out copper as pure metal in slab-like form on the cathode without forming metal compounds and copper powder in the cathode compartment, and also to substantially retain ammonia and ammonium compound content of the used etching solution as introduced into the cathode compartment.

2. A process as defined in claim 1 wherein, the used ammonium copper solute containing etching solution is continuously introduced into and moved through and out of the cathode compartment, and its copper content is substantially reduced and continuously plated on the cathode during such movement.

3. A process as defined in claim 2 wherein, the used ammonium copper solute containing etching solution is metered into a lower portion of the cathode compartment, and reconditioned reuseable ammonium etching solution is removed from an upper portion of the compartment at substantially the same rate as the used etching solution is metered into the compartment.

4. A process as defined in claim 2 wherein, the used etching solution as introduced into the cathode compartment has a copper soluble content of about 180 to 200 g/l, and such copper solute content is reduced therein to a concentration of about 80 g/l or less before it is removed from the cathode compartment.

5. A process as defined in claim 1 wherein, an ammonium salt selected from the group consisting of a sulfate, a chloride, an acetate and a sulfamate is employed in the anodic compartment to provide an ammonium ion concentration therein within a range of about 1.5 to 20 g/l, and the pH of the solution in the anode compartment is maintained within a range of about 4.0 to 10.0.

6. A process as defined in claims 1 or 5 wherein, the solution in the cathode compartment is maintained at a pH of less than about 8.0 and the pH of copper depleted solution removed from the cathode compartment is increased to more than about 8.0 before it is reused in a copper etching bath.

7. A process as defined in claim 1 wherein the copper etching solution in the cathode compartment attains a concentration of about 80 g/l or less in the cathode compartment, and the copper solute content of the used solution being introduced into the cathode compartment is about 180 to 200 g/l.

8. A process as defined in claim 2 wherein the pH of the solution in the cathode compartment is maintained at a pH of less than about 7.6 to avoid loss of ammonia therefrom due to evaporation.

9. A process as defined in claim 2 wherein, the ammonium ion concentration in the anode compartment is maintained within about 1.5 to 20 g/l and its pH is maintained with a range of about 4.0 to 10.0 to minimize migration of ammonia from the cathode into the anode compartment.

10. A process as defined in claim 9 wherein an ammonium salt concentration of about 20 to 80 g/l ia maintained in the anode compartment.

11. A process as defined in claim 3 wherein, the used etching solution is introduced into the cathode compartment and reconditioned etching solution are respectively moved into, through and out of the cathode compartment at a rate such that the copper solute content of entering solution will be quickly reduced from about 180 to 200 g/l to about 80 g/l or less while the solution is moved from an inlet portion of the compartment through the compartment and out from an opposite outlet portion of the compartment.

12. A process as defined in claim 2 wherein, the solution in the cathodic compartment is agitated and its temperature is kept at about 130° F. or below, and at least about 1.24 KW/hr of direct current is supplied per kg. of solution to the electrodes during the operation.

13. A process as defined in claim 2 wherein, the copper solution concentration of the etching solution is maintained within a range of about 5 to 80 g/l within the cathodic compartment during the operation, the voltage applied to energize the electrode anode is at least 1.8 and the amperes/sq. ft. of surface electrode is at least about 73.7.

14. A method of recovering pure copper metal in film or slab-like form from and of continuously reconditioning a used copper solute copper containing etching solution which comprises, providing an electrolytic cell with anode and cathode compartments isolated from each other by a cationic permeable membrane, providing a cathode electrode in the cathode compartment and an anode electrode in the anode compartment, initially making up a typical ammoniacal copper etching solution and introducing it into the cathode compartment, initially making up an ammonia sulfate solution and introducing it into the anode compartment, thereafter energizing the cell by an application of electrical potential to the electrodes, while introducing a used copper solute containing ammoniacal etching solution into a bottom portion of the cathode compartment, moving the used solution through the cathode compartment and continuously removing it from an upper portion of the cathode compartment, controlling the application of electricity of the electrodes in such a manner as to assure plating out of copper in pure metallic form on the cathode from the copper solution, and controlling the concentrations of and the pH of the ammonium solution in the anode compartment and of the used etching solution moving through the cathode compartment to substantially retain the ammoniacal and ammonium compound of the used solution and to substantially deplete its copper solute content before it is removed from the upper portion of the cathode compartment.

15. A method of recovering pure copper metal in film or slab-like metal form from and of continuously reconditioning a used copper solute copper containing etching solution which comprises, providing an electrolytic cell with anode and cathode compartments separated from each other by a cationic permeable membrane, providing a cathode electrode in the cathode compartment and an anode electrode in the anode compartment, initially making up a typical ammoniacal copper etching solution and introducing it into the cathode compartment, initially making up an ammonia sulfate solution and introducing it into the anode compartment, thereafter electrically energizing the cell by an application of electric current and potential to the electrodes, while introducing a used copper solute-containing ammoniacal etching solution into a bottom portion of the cathode compartment and continuously removing it from an upper portion of the cathode compartment, and while maintaining its pH at less than about 8.0 and effecting a reduction of its copper solute content to a concentration of about 80 g/l and less; and controlling the application of electricity to the electrodes and the pH and ammonium ion concentration in the anode chamber in such a manner as to assure plating out of copper in pure metallic form on the cathode from the etching solution and with a substantial retention of its ammoniacal etching content.

16. A method as defined in claim 15 wherein, the temperature of the etching solution is maintained at 130° F. and below while it is agitated within the cathode chamber, and at least 1.24 KW/hr of direct current per kg. of etching solution is applied to the electrodes during the operation.

* * * * *